US006698774B2

(12) United States Patent
Duncan

(10) Patent No.: US 6,698,774 B2
(45) Date of Patent: Mar. 2, 2004

(54) PARALLEL SPACING GUIDE

(76) Inventor: James Alvin Duncan, 1545 Jess St., Pomona, CA (US) 91766

( * ) Notice: Subject to any disclaimer, the term of this patent is extended or adjusted under 35 U.S.C. 154(b) by 0 days.

(21) Appl. No.: 10/099,396

(22) Filed: Mar. 16, 2002

(65) Prior Publication Data

US 2002/0140192 A1 Oct. 3, 2002

Related U.S. Application Data

(60) Provisional application No. 60/277,559, filed on Mar. 22, 2001.

(51) Int. Cl.[7] ..... B62D 61/00

(52) U.S. Cl. ..... 280/63; 280/79.6; 222/608; 222/611.1; 239/147

(58) Field of Search ..... 222/608, 610, 222/611.1; D23/213, 223, 225, 226; D34/14, 24; 239/146, 147, 722; 280/63, 79.6

(56) References Cited

U.S. PATENT DOCUMENTS 3,687,371 A * 8/1972 Swager ..... 239/150
4,099,482 A * 7/1978 Smrt ..... 118/712
4,262,821 A * 4/1981 Smrt ..... 222/162
4,345,544 A * 8/1982 Besecker ..... 118/108
4,545,531 A * 10/1985 Williams ..... 239/150
4,599,968 A * 7/1986 Ryder et al. ..... 118/305
4,624,602 A * 11/1986 Kieffer et al. ..... 404/94
4,892,251 A * 1/1990 Bresnen ..... 239/150
4,943,008 A * 7/1990 Smrt ..... 239/754
5,302,207 A * 4/1994 Jurcisin ..... 118/713
5,368,232 A * 11/1994 Schroeder ..... 239/165
5,518,148 A * 5/1996 Smrt ..... 222/174
5,573,148 A * 11/1996 Poole et al. ..... 222/611.1
5,749,522 A * 5/1998 Smrt ..... 239/71
6,062,443 A * 5/2000 Smrt ..... 222/608

* cited by examiner

*Primary Examiner*—Brian L. Johnson
*Assistant Examiner*—Brian L Swenson
(74) *Attorney, Agent, or Firm*—L. Kenneth Rosenthal

(57) ABSTRACT

The invention relates to a parallel spacing guide that when attached to a hand-held marking device (spray gun), it enables the user to mark an accurate and consistent extended line one to four feet from a curb, wall, or other vertical surface; and one to four feet from a line or score mark along the ground in cases where a vertical surface is temporarily absent. This is achieved by having the parallel spacing guide soundly attached to a hand-held marking device. While holding the parallel spacing guide in one hand by the embodied handle and the attached marking device by it's handle in the other hand, the user pushes the invention along the street or highway with the end of the parallel spacing guide butted against the curb or wall while simultaneously using the marking device to mark the line by discharging paint or chalk.

5 Claims, 5 Drawing Sheets

PARALLEL SPACING GUIDE

RELATED APPLICATIONS

This invention claims priority from provisional application 60/277,559 filed Date Mar. 22, 2001. Duncan Parallel Guide

BACKGROUND OF THE INVENTION

1. Field of Invention

The field of the invention relates to marking paint lines on street surfaces. The invention will be used primarily for construction and maintenance purposes, and particularly, but not limited to freeway, highway, street maintenance and construction. The invention consists of a parallel spacing guide (and method) that when attached to a hand-held marking device (spray gun) enables the user to mark an accurate and consistent extended line one to four feet from a curb, wall or other vertical surface.

2. Description of Prior Art

Marking extended lines in an accurate and consistent one to four foot distance from a curb or other vertical surface along a road or highway has been achieved by butting a template against the said vertical surface and marking a line against it with an aerosol paint can, spray gun or paint brush. This process is repeated over and over until the desired length of the line is finally achieved. This repeated bending process is tedious, tiring, time consuming, and may result in back pain.

Another method that has been employed is using a chord or string line; where the desired distance is measured from the curb or wall at both extreme ends of the string or chord and third person then paints over the string or chord with paint and subsequently a line is marked on the ground by the paint that naturally exceeds over the sides of the narrow chord or string. The problem with this process is that it requires three (3) people bending over and measuring; and requires a significant amount of time.

There are devices that have been used to mark traffic lane stripes on streets and highways; and there are spray guns used to mark lines on streets for the purpose of laying out intended work. These devices all require the user to first measure out the line of work, and then use the device to mark the already laid out line.

In the prior art no method has been devised to allow one person to mark an accurate and consistent extended line on the ground one to four feet from a curb or other vertical surface without having to continually stop, measure and bend over to mark. There presently exists no such low cost, light weight, compact, easy to use spacing guide for use with a hand-held marking device which can very quickly and accurately mark lines on street surfaces.

SUMMARY

The invention relates to a parallel spacing guide used for marking an accurate and consistent line one to four feet from a curb or vertical surface. The invention is comprised of a rigid body consisting of crossing or intersecting members to provide rigidity, a pole attached to said rigid body to be used as a handle necessary for easy and accurate drawing, a guide wheel attached to said rigid body for rolling against the face of a curb or other vertical surface providing an accurate and continuously consistent distance between curb and line being marked, and two or more parallel street wheels attached at the bottom of rigid body. The first said parallel street wheel is positioned in front and the second said parallel street wheel positioned in back; to provide stability, cause the afore mentioned guide wheel to lay perfectly perpendicular against the curb at all times, and keep the invention rolling parallel to the curb with ease while marking the extended line.

A further object of the invention is to allow the user to mark an accurate and consistent extended line where there is no curb or vertical surface to roll against. This is achieved by attaching a pointer to the bottom of the guide wheel mentioned above. The said pointer drags along the ground from the stationary center of the guide wheel and is used as a visual guide.

DESCRIPTION OF THE PREFERRED EMBODIMENTS

Figure 1:
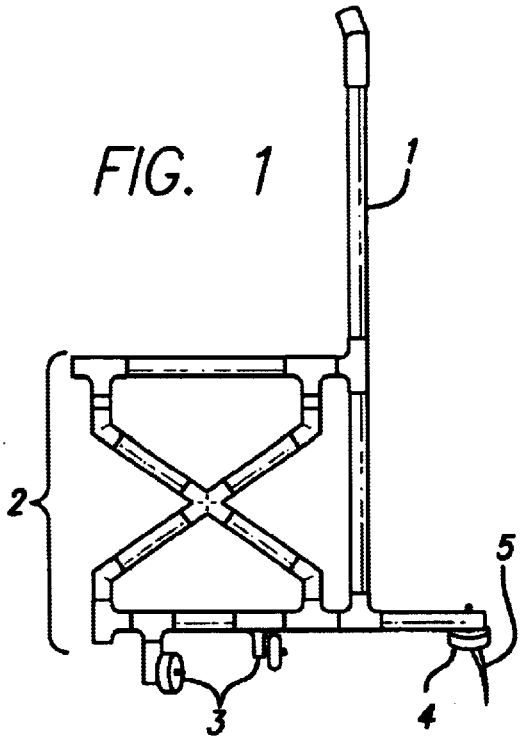
FIG. 1 is a front view of the parallel spacing guide.
Figure 3:
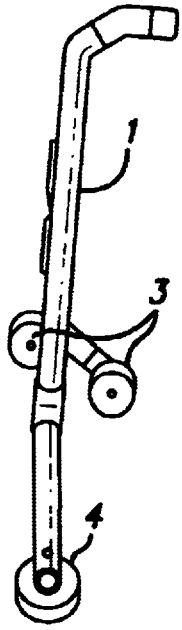
FIG. 3 is a side view of the parallel spacing guide
Figure 2:
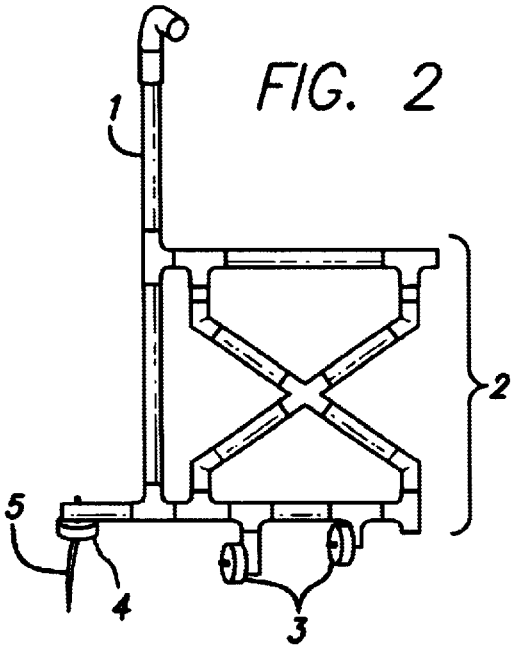
FIG. 2 is a rear view of the parallel spacing guide.

In FIG. 1 and FIG. 2, 1 is the pole attached to the body of the parallel spacing guide used as a handle. 2 is the rigid body with crossing members that provide rigidity whose function is to provide the consistent spacing between the vertical surface and the line being painted by marking device. 3 are the parallel street wheels that roll along the ground. They keep the parallel spacing guide rolling straight and keep the guide wheel perpendicular to the vertical surface it rolls against. 4 is the guide wheel which is attached to the rigid body. The guide wheel is in constant contact with the vertical surface, insuring the consistent spacing between the said vertical surface and line being painted, as the parallel spacing guide is in use. In another embodiment guide wheel means can be in the form of a cylindrical shaped roller or a roller comprising at least one ball. 5 is the pointer which is used as a visual guide when necessary, in cases where there exists no vertical surface for guide wheel to roll against. In FIG. 3, a side view of the parallel spacing guide, 1 is the pole attached to rigid body (not in view). 3 are the parallel street wheels that roll along the ground. They are positioned on opposite sides of the rigid body 2, providing balance and stability to the unit., and as they roll along the ground they keep the guide wheel 4 rolling perpendicular to the vertical surface it rolls against.

Figure 4:
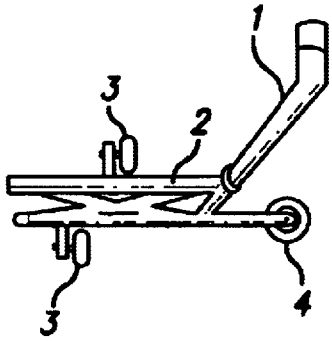
FIG. 4 is a top view of the parallel spacing guide

In FIG. 4 a top view of the parallel spacing guide, 1 is the pole attached to rigid body of the parallel spacing guide used as a handle. 2 is the rigid body whose function is to provide the consistent spacing between the vertical surface and line being painted by marking device. 3 are the parallel street wheels that roll along the ground. They are positioned on opposite sides of the rigid body 2 providing balance and stability to the unit, and as they all roll along the ground, they keep the guide wheel 4 rolling perpendicular to the vertical surface it rolls against.

Figure 5:
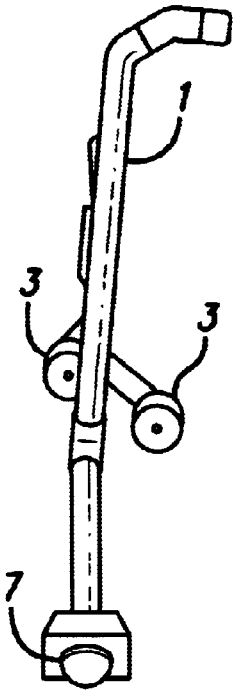
FIG. 5 is a side view of the parallel spacing guide where in the guide wheel means is a roller.
Figure 6:
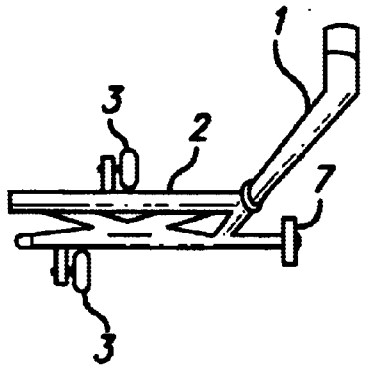
FIG. 6 is a top view of the parallel spacing guide where in the guide wheel means is a roller.
Figure 7:
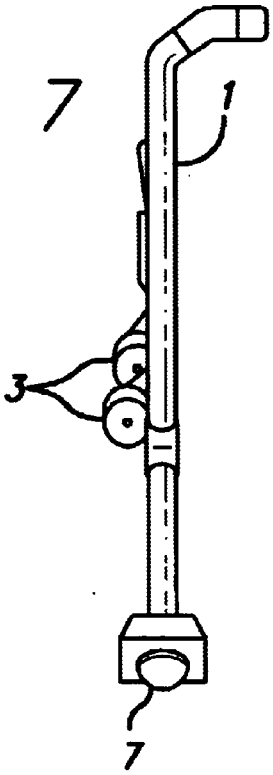
FIG. 7 is a side view of the parallel spacing guide where in the guide wheel means is a roller, and the parallel street wheels are arranged side by side.
Figure 8:
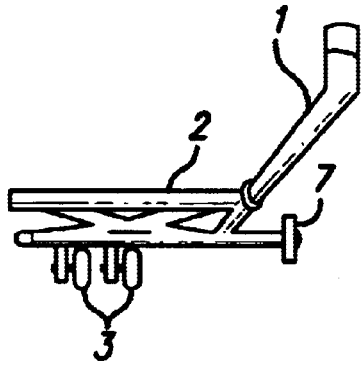
FIG. 8 is a top view of the parallel spacing guide where in the guide wheel means is a roller, and the parallel street wheels are arranged side by side.
Figure 9:
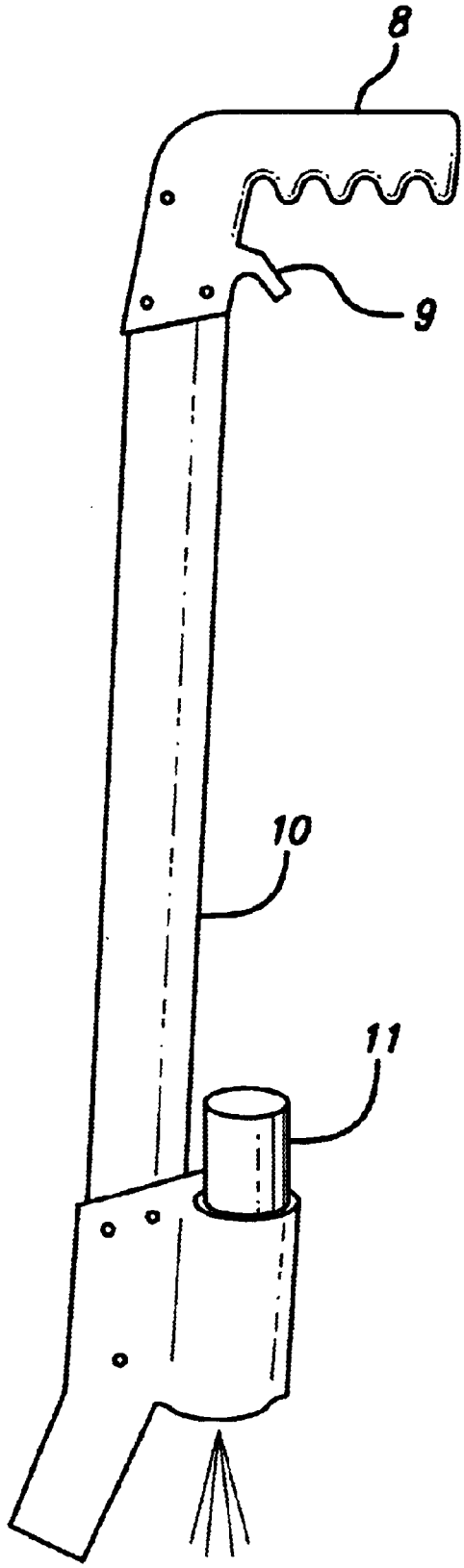
FIG. 9 is a drawing of a typical hand-held spray gun for use with the parallel spacing guide.
Figure 10:
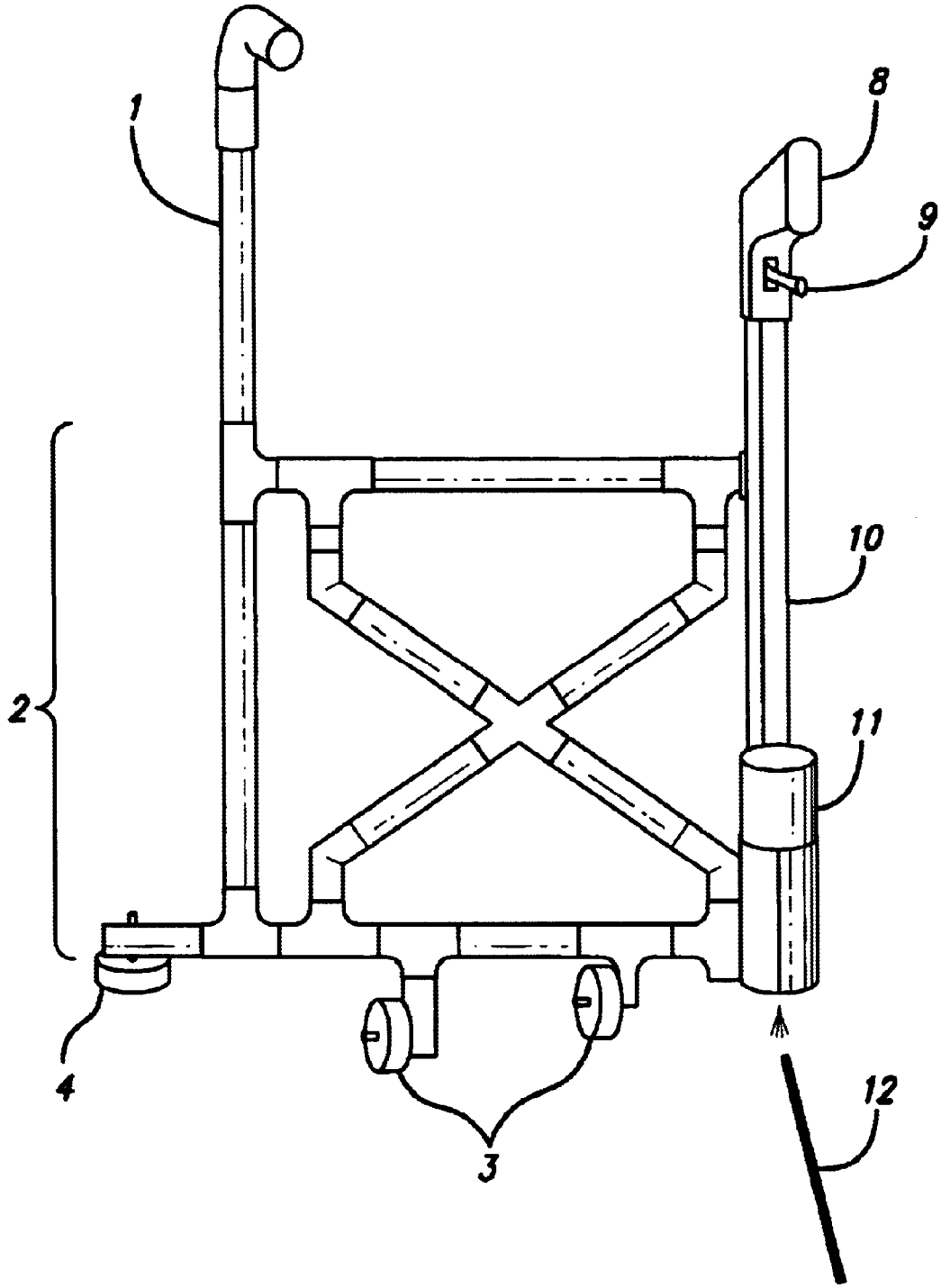
FIG. 10 is a drawing of the parallel spacing guide attached to typical spray gun in use.
Figure 11:
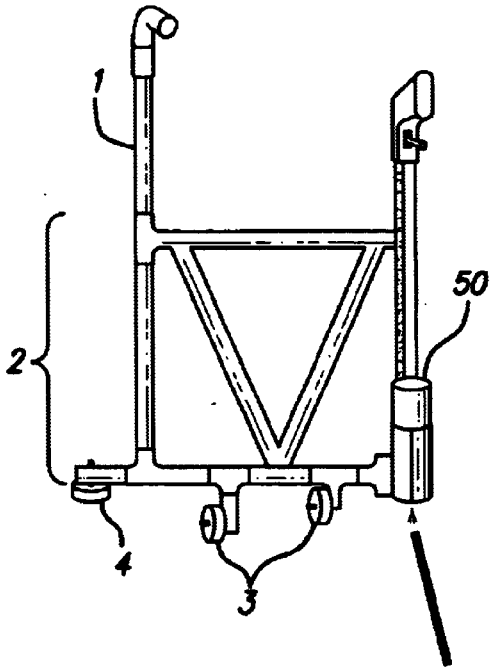
FIG. 11, FIG. 12, FIG. 13, and FIG. 14 are examples of the many possible embodiments of the rigid body comprising intersecting members. Shown are rear view drawings with spray gun attached.
Figure 12:
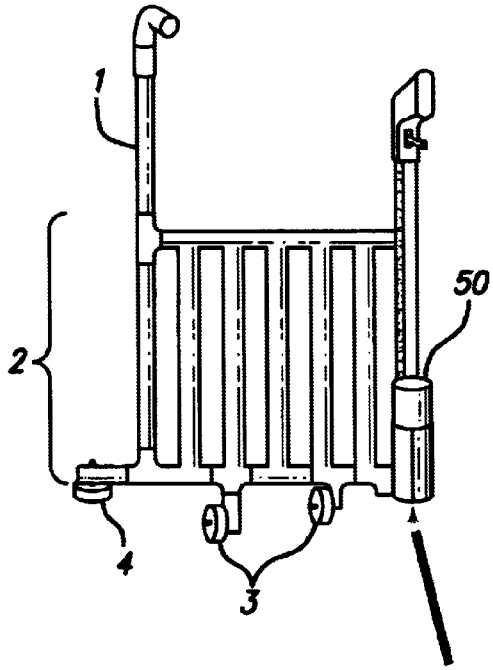
Figure 13:
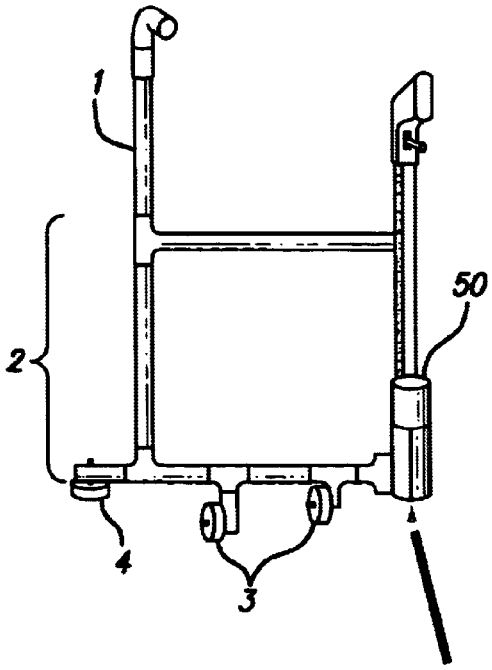
Figure 14:
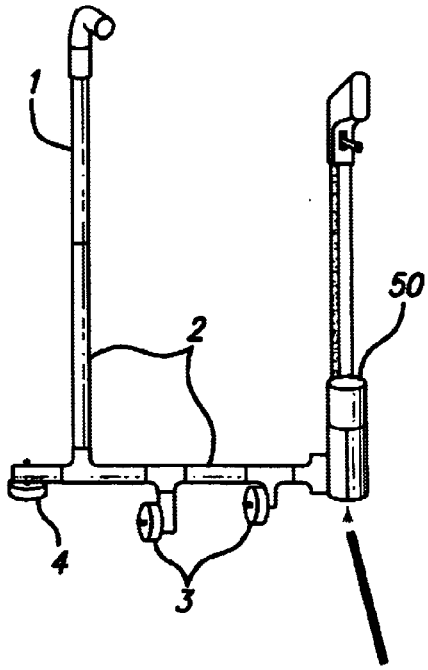

In FIG. 5 and FIG. 6, 7 is a second embodiment of the guide wheel means in the form of a roller comprising a ball and housing for said ball to attach to rigid body. FIG. 7 and FIG. 8 are another embodiment of the invention wherein the guide wheel means 7 is a roller comprising a ball and housing for said ball to attach to rigid body 2. The parallel street wheels 3 in this case are arranged side by side and each positioned slightly in front of rigid body 2. This positioning of the parallel street wheels is an option when guide wheel means is a roller. FIG. 9 is a drawing of a typical hand-held spry gun comprising a handle, whose internal mechanism encased in spray gun body 10 releases paint from paint reservoir 11 by pressing against release nozzle on aerosol paint can. FIG. 10 shows from a rearview the parallel spacing guide attached to a typical hand-held spray gun in use. The invention is held by the handle 1 in one hand and by the handle of the spray gun 8 in the other hand. With the guide wheel means 4 butted against a vertical surface, and all parallel street wheels 3 resting on the ground, the invention is pushed along the street with all wheels rolling simultaneously. The trigger to the spray gun 9 is depressed, and the internal mechanism in spray gun body 10 subsequently presses against the spray can nozzle in paint reservoir 11 and discharges paint 12 in the form of a straight line along the surface of the street, the paint line measuring exactly the width from the vertical surface as the breadth of the rigid body 2 between vertical surface and said hand-held spray gun.

In FIG. 11, FIG. 12, FIG. 13, and FIG. 14, 1 is the pole attached to the body of the parallel spacing guide used as a handle. 2 is the rigid body with intersecting members whose function is to provide the consistent spacing between the vertical surface that the guide wheel means 4 rolls against and the line being painted by the spray gun. 3 are the parallel street wheels that roll along the ground; whose function is to keep the parallel spacing guide rolling straight and the guide wheel means perpendicular against the vertical surface it rolls against. 4 is the guide wheel means which is attached to the rigid body. 50 is the spray gun in use which is attached to said parallel spacing guide.

The invention having been described in its preferred embodiments, it is clear that it is susceptible to numerous modifications and embodiments within the ability of those skilled in the art and without the exercise of the inventive faculty. Accordingly, the scope of the invention is defined by the scope of the following claims.

I claim:

1. A line marking apparatus having a spacing guide attached to a spray gun which enables a user to mark an extended line or curve a consistent distance from a vertical surface or horizontal line comprising: a rigid body including: generally vertically positioned crossing or intersecting members providing rigidity to the rigid body, a pole to be used as a first handle for a hand of the user attached to a side of said rigid body, the pole positioned in approximately a vertical position, a guide wheel means attached to said rigid body for rolling against the face of a street curb or other vertical surface providing an accurate and continuously consistent distance between the curb and line being marked, a spray gun body positioned in approximately a vertical position attached to said rigid body on a side opposite said pole, the spray gun body including on one end a second handle for a hand of the user and a trigger to release paint stored in a reservoir located on the opposite end of the spray gun body of the second handle, and at least two parallel street wheel means attached to the bottom of the rigid body parallel to the direction of travel and offset on opposite sides of said rigid body to provide balance and stability for keeping the guide wheel perpendicular to the vertical surface.

2. The spacing guide in claim 1 wherein guide wheels means is a pointer.

3. The spacing guide in claim 1 wherein guide wheels means is a roller of cylindrical shape.

4. The spacing guide in claim 1 wherein guide wheels means is a roller comprising at least one ball.

5. A method for marking an extending line or curve on a street surface within four feet from a curb, wall, vertical surface, or horizontal line using a spacing guide having a rigid body positioned in approximately a vertical position, the rigid body including: generally vertically positioned crossing or intersecting members providing rigidity to the rigid body, a pole to be used as a first handle for a hand of the user attached to a side of said rigid body, the pole positioned in approximately a vertical position, a guide wheel means attached to said rigid body for rolling against the face of a street curb or other vertical surface or horizontal line providing an accurate and continuously consistent distance between the curb and line being marked, a spray gun body positioned in approximately a vertical position attached to said rigid body on a side opposite said pole, the spray gun body including on one end a second handle for a hand of the user and a trigger to release paint stored in a reservoir located on the opposite end of the spray gun body of the second handle, and at least two parallel street wheel means attached to the bottom of the rigid body parallel to the direction of travel and offset on opposite sides of said rigid body to provide balance and stability for keeping the guide wheel perpendicular to the vertical surface, holding said rigid body in an approximately vertical position, applying pressure to the trigger located near the top of the spray gun body which activates paint in said spray gun to produce said extended line or curve.

* * * * *